United States Patent [19]

Kobler et al.

[11] Patent Number: 4,805,530

[45] Date of Patent: Feb. 21, 1989

[54] PRINTING MACHINE INKER SYSTEM

[75] Inventors: Ingo Kobler, Anhausen; Georg Hartung, Augsburg, both of Fed. Rep. of Germany

[73] Assignee: M.A.N. Roland Druckmaschinen AG, Offenbach am Main, Fed. Rep. of Germany

[21] Appl. No.: 157,868

[22] Filed: Feb. 19, 1988

[30] Foreign Application Priority Data

Feb. 25, 1987 [DE] Fed. Rep. of Germany ..... 3706011

[51] Int. Cl.[4] ..... B41J 31/06

[52] U.S. Cl. ..... 101/350; 101/157

[58] Field of Search ..... 101/350, 363, 366, 207–209, 101/170, 169, 157

[56] References Cited

U.S. PATENT DOCUMENTS

| | | | |
|---|---|---|---|
| 1,656,170 | 1/1928 | Cooper | 101/220 |
| 3,360,393 | 12/1967 | Rhorer | 264/284 |
| 3,587,463 | 6/1971 | Granger | 101/350 |
| 4,208,963 | 6/1980 | Dahlgren | 101/363 X |
| 4,428,291 | 1/1984 | Dorow | 101/350 |
| 4,527,471 | 7/1985 | Dahlgren et al. | 101/350 |

FOREIGN PATENT DOCUMENTS

| | | | |
|---|---|---|---|
| 2508397 | 9/1975 | Fed. Rep. of Germany | 101/170 |
| 3541458 | 5/1987 | Fed. Rep. of Germany | 101/366 |

*Primary Examiner*—Edgar S. Burr
*Assistant Examiner*—James Lisehora
*Attorney, Agent, or Firm*—Frishauf, Holtz, Goodman & Woodward

[57] ABSTRACT

To permit accurate control of ink being transferred by an ink transfer roller from an ink source (6; 15, 16, 17) to an ink accepting roller (1, 10), the transfer roller (2, 11) has a surface layer (3, 12) which is made of compressible material, the surface layer being formed with shallow cup-like depression in a grid or similar raster pattern. Upon compression and deformation of the depth of the shallow cup-like depressions, the cup-like depressions will change their volume and thus change the quantity of ink being transferred. This also permits direct inking of a forme cylinder (1) by a chamber ink supply arrangement (6) since the hard surface of the forme cylinder will be engaged by the resilient or compressible surface layer (3, 12) of the transfer roller.

10 Claims, 1 Drawing Sheet

PRINTING MACHINE INKER SYSTEM

The present invention relates to an inker, and more particularly to an ink transfer roller having a profiled surface, for example in a grid pattern, which forms shallow cups for inking an ink receiving roller, for example a forme cylinder.

BACKGROUND

The cited literature "Technik des Flexodrucks" ("Technology of Flexo Printing", Coating Textbooks) page 2.5, describes an inker with a minimum number of rollers used to ink a plate cylinder or a forme cylinder, by using an ink application roller which has a screen-type surface. Surfaces of this type, as known, are usually either made of metal or ceramic. Ink transfer rollers of this type are usually engaged by a doctor blade. It is practically impossible to individually control the quantity of ink being transferred by engagement of a doctor blade with a profiled surface which is metallic or ceramic. It is also known to control the ink quantity being applied by utilizing rollers of different types of profiled surfaces, that is, of different screen-mesh for example. This permits application of defined quantities of ink. Page 3.13 of the aforementioned textbook describes and recommends such an arrangement.

Stocking ink transfer rollers having different surfaces for different applications causes storage problems and, further, results in excessive installation and re-installation costs, if rollers are to be changed merely because the ink supply needs to be changed. It is also not possible to engage an ink application roller with a hard surface, such as a metallic or ceramic surface directly on a forme cylinder which, likewise, has a hard surface.

THE INVENTION

It is an object to provide an ink transfer roller in an inker of the type described which can be directly engaged with a forme or other roller having a hard surface, and in which, preferably, also the quantity of ink to be applied can be accurately metered.

Briefly, the ink application roller has an ink accepting surface which is formed by a layer of a compressible material, for example a plastic material.

The arrangement has the advantage that by using a compressible layer, not only can the application roller be directly engaged against another roller in the system having a hard surface but, further, the quantity of ink can be easily metered because a doctor blade, engaged against a compressible profiled surface, can slightly compress the surface and thus strip a metered quantity of ink off the surface of the application roller.

DRAWINGS

FIG. 1 is a highly schematic side view of an ink application roller in accordance with the present invention, applied against a forme cylinder of a printing machine system; and FIG. 2 illustrates an ink application roller in accordance with the present invention being inked by an ink trough roller.

DETAILED DESCRIPTION

Figure 1:
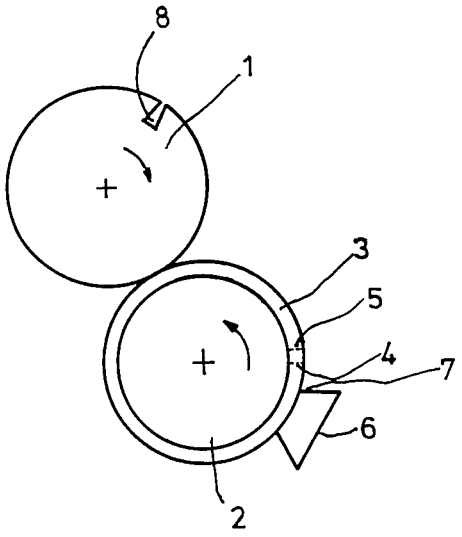

A plate or forme cylinder 1 (FIG. 1) can be engaged directly for surface contact with a profiled ink application roller 2, if the profiled ink application roller has a carrier layer 3 thereon which is made of a compressible material. The profiled surface, for example a screen or mesh-patterned surface can be constructed and shaped as well known, to define small shallow cup-shaped depressions between ridges. The layer 3 can be made of plastic material which is inherently compressible. This compressible, and hence elastic carrier layer 3 has the screen pattern applied thereto and, thus, is formed with depressions to receive ink. The forme cylinder 1 can be covered with a printing plate or printing forme with a hard surface.

The layer 3 can be applied in various ways. In one example, and in a preferred form, the flexible layer 3 is applied to a cylindrical structure forming the roller 2 in form of a thin-walled tube, secured to the body of the roller 2 to be readily removed therefrom. Such a tube is preferably seamless. It can be secured to the roller body 2 by an expansion grip or holder.

In accordance with another feature of the invention which, for various applications has specific advantages, the elastic layer 3 is applied to a roller body 2 by vulcanization or by spraying the elastic material on the roller. The diameter of the body of the roller 2 can be the same, or less than the diameter of the forme cylinder 1, the patterning on the surface of the roller 3 being seamless. The size and type of patterning used can be in accordance with any well known arrangement.

It is of course also possible to provide a patterned region on the carrier layer 3 only over that portion which corresponds to the length of the material on which printing is to be effected. In the region where the clamping groove 8 on forme cylinder 1 would come in contact with the surface of the cover 3 on the roller 2, no patterning or depressions are used. This is schematically shown in FIG. 1 by lines 4 and 5 which, respectively, indicate the beginning of screening, and then around the roller, the end of the screening or profiled surface. The surface of the layer 3 is inked by an ink chamber arrangement 6, well known as such, to apply ink directly. The limit structure of the ink chamber arrangement 6 itself forms a stripping element, similar to a doctor blade, as schematically shown at 7.

Figure 2:
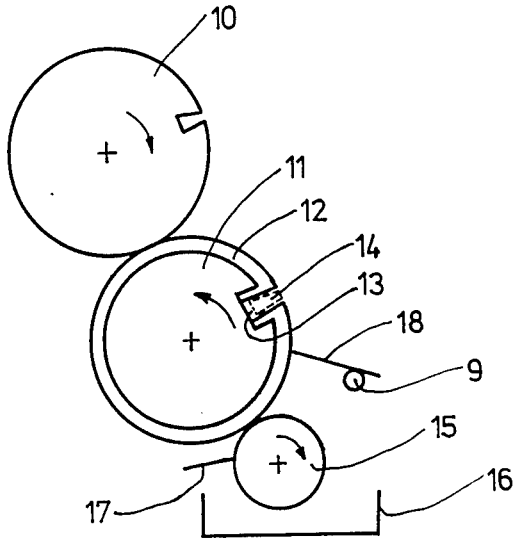

FIG. 2 illustrates a forme cylinder 10 which is inked by an ink application roller 11. Ink application roller 11 has a flexible layer 12 applied to the outer surface, which layer 12 is formed with a profiled surface similar to the profiled surface of the layer 3 (FIG. 1). The layer 12 is attached to the body of the roller 11 by engagement with a groove 13 and suitable holding mechanisms therein, as well known in the printing machine field. This permits easy exchange of the layer 12, for example upon wear of the layer 12. The groove 13 can be closed by a filler strip 14.

The ink application roller 12 can be inked as shown in FIG. 1 by an ink chamber or, and as specifically shown in FIG. 2, by a metering trough roller 15, dipping into ink in an ink trough 16. A doctor blade 17 strips ink from the roller 15 so that only that portion of the ink which is to be transferred to the profiled surface of the layer 12 will be applied thereto. The shallow cup-like depressions in the carrier layer 12 will change their volume upon engagement with a doctor blade 18 being applied to the surface of layer 12. By more or less tight pressure of the blade 18 against the surface of the layer 12, the volume of the depressions formed in the profiled surface of the layer 12 will change and thus change the quantity of ink which is being transferred to the roller 10 in accordance with the ink requirement thereof. An adjustment mechanism, only schematically shown at 9, and of any suitable type well known in the industry, may be used to control the pressure of the doctor blade 18. An eccentric forms a suitable adjustment mechanism. The respective rollers in FIGS. 1, 2 have arrows therein, indicating the relative directions of rotation.

The layer 3 (FIG. 1) preferably is seamless and, then, inking is preferably done by the ink chamber arrangement 6. If the roller 11 (FIG. 2) has a groove, the cup-like depressions on the surface of the layer 12 are preferably filled with a metering roller, as shown, the metering roller 15. This is particularly applicable when the groove or gap 13 in the roller 11 is not closed. Excess ink on the roller 11, after filling of the cup-like depressions by the metering roller 15 is stripped off by the doctor blade 18. An ink chamber construction similar to the ink chamber 6 (FIG. 1) can be used in the arrangement of FIG. 2 if the groove 13 is closed, for example by a filler strip 14.

Use of a compressible layer 3, 12 in this arrangement permits change of the volume of the depressions on the profiled surface of the rollers 2, 11 and thus control of the ink to be applied on the respectively engaged ink accepting rollers 1, 10.

Various changes and modifications may be made, and features described in connection with one of the embodiments may be used with the other, within the scope of the inventive concept.

A suitable material for the layers 3, 12 is: a polymer or a photopolymer.

We claim:

1. Printing machine inker having a forme or plate cylinder (1), an ink source (6; 15, 16, 17), and an ink application roller (2) receiving ink from the ink source and directly engaging and applying ink to the forme or plate cylinder, said ink application roller having an ink accepting surface which is formed with shallow cup-like depressions, and wherein said ink accepting surface is formed by a layer of a compressible material; and means for selectively controlling the depth of said shallow cup-like depressions on the ink accepting surface, said means comprising means (7, 18) engageable with said compressible material having said ink accepting surface, means to control the pressure of engagement of said means engageable to vary the depth of said shallow cup-like depressions to thereby control the quantity of ink being applied to said forme or plate cylinder (1).

2. The inker of claim 1, wherein said ink application roller (2) comprises an ink transfer roller body and the ink accepting surface comprises the surface of a thin-walled tube releasably secured on the roller body.

3. The inker of claim 1, wherein the ink application roller comprises a roller body or core;

and said compressible material comprises vulcanized sprayed-on material.

4. The inker of claim 1, wherein said ink source comprises an ink chamber arrangement (6).

5. The inker of claim 1, wherein the ink application roller (11) is formed with an axially extending groove (13);

and wherein said compressible material includes a plate-like carrier, secured in the groove (13) of the ink application roller (11).

6. The inker of claim 5, further including a filler element (14) closing off the groove (13) towards the outside.

7. The inker of claim 1, wherein the means engageable with said layer of compressible material includes compression means engageable with the ink accepting surface of the compressible material to deform said compressible material.

8. The inker of claim 7, wherein said means engageable with said layer of compresible material having said surface comprises a blade means (7, 18) and means (9) for selectively changing the compression force of said blade means applied on said surface.

9. The inker of claim 1, wherein the forme or plate cylinder (1) has a hard, unyielding surface.

10. The inker of claim 9, wherein said hard or unyielding surface on the forme or plate cylinder (1) comprises ceramic or steel.

* * * * *